United States Patent [19]

McGrath-Saleh

[11] Patent Number: 4,802,244

[45] Date of Patent: Feb. 7, 1989

[54] PREMATURE INFANT BEDDING CONSTRUCTION

[76] Inventor: Melissa McGrath-Saleh, 1219 Amesbury, Liberty, Mo. 64068

[21] Appl. No.: 90,518

[22] Filed: Aug. 28, 1987

[51] Int. Cl.[4] ..... A41B 13/06; A47G 9/00

[52] U.S. Cl. ..... 2/69; 2/69.5; 2/80; 5/494

[58] Field of Search ..... 2/69, 69.5, 80; 5/494

[56] References Cited

U.S. PATENT DOCUMENTS

| | | | |
|---|---|---|---|
| 2,628,358 | 2/1953 | Neils | 2/69.5 |
| 3,034,132 | 5/1962 | Landsberger et al. | 2/69.5 |
| 3,284,818 | 11/1966 | Lutz | 2/69.5 X |
| 4,241,458 | 12/1980 | Lesesne | 2/69.5 |
| 4,597,121 | 7/1986 | Bouma | 2/69 X |

*Primary Examiner*—Louis K. Rimrodt

[57] ABSTRACT

Improvement in apparatus, means and methods for receiving, holding and stabilizing the position of prematurely born infants; a bedding pad of particular configuration adapted to receive thereon the prone body of a prematurely born infant, such base or bedding pad having associated therewith a U shaped retainer, collar or peripheral wall of limited height adapted to receive therewithin, as well as be contained therewithin, most of the body (torso and legs) of the prematurely born infant in such manner as to stabilize the infant in the optimum resting and sleeping posture, as well as provide surfaces and structures against which the "premie" may lie, rest, push and interact in a manner conducive to the physical and mental health of the infant, there also being provided a loin cloth like harness longitudinally adjustable on the base pad and peripheral wall thereby to fit and receive the diapered bottoms of prematurely born infants of varying size; the surfaces with which the infant comes into contact, on the top surface of the base pad and the inner surface of the retainer collar or wall or the like most preferably being of lambskin, with the wool thereof in contact with or contactable by the said premature infant.

19 Claims, 3 Drawing Sheets

Fig.9.
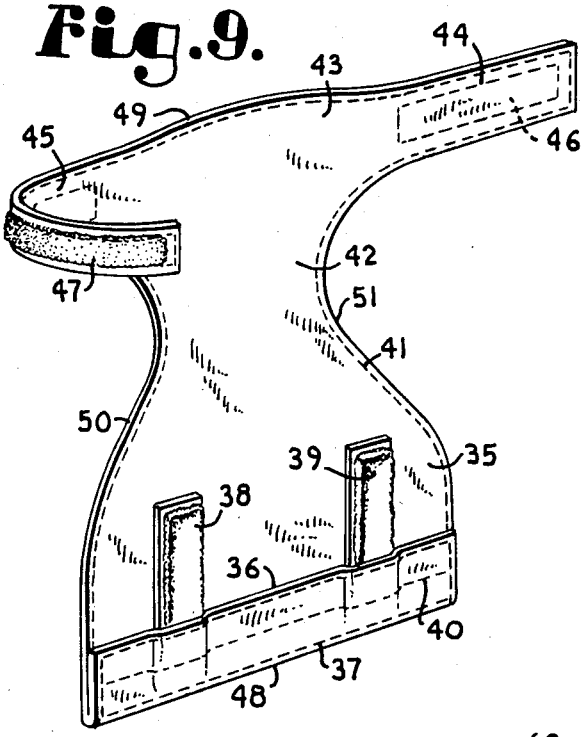
Fig.10.
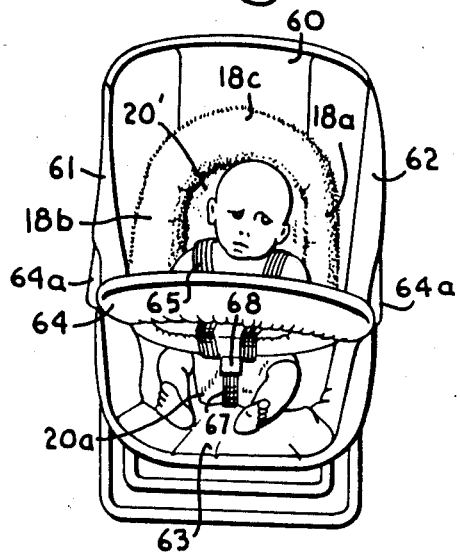
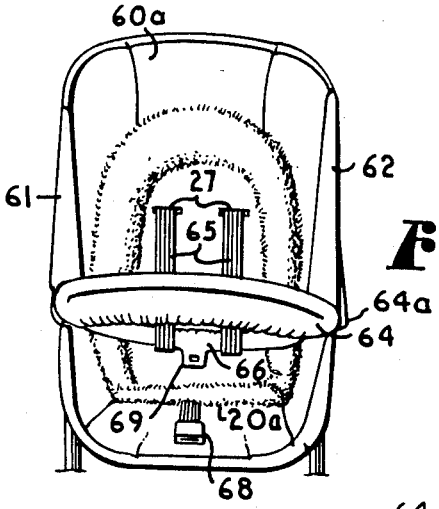
Fig.11.
Fig.13.
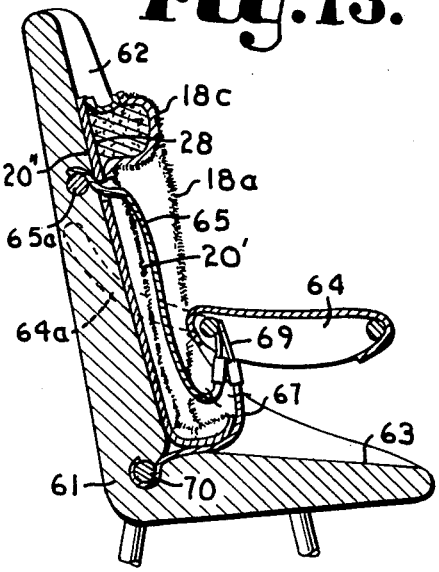
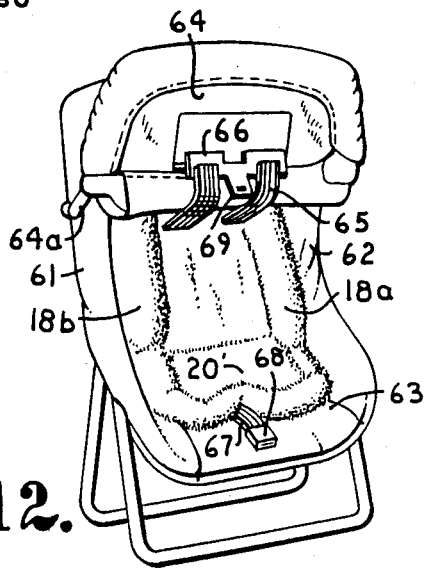
Fig.12.

PREMATURE INFANT BEDDING CONSTRUCTION

BACKGROUND OF THE INVENTION

It is theorized from the available current body of research literature that lambskin provides sensorially advantageous experiences in the area of olfactory and tactile learning. A beginning research base regarding the value of lambskin is in its early stages. It is currently acknowledged that there may exist direct associations between infant sleep and lambskin use. Other associations perhaps linked with lambskin use include changes in crying behaviors, changes in fretful behaviors, changes in trusting behaviors, changes in self consoling behaviors and temperature control. Because wool is a natural fiber, there are physical and natural properties thereo that appeal to use with infants.

As valuable as the tactile experience of lambskin seems to be, it is also theorized that positioning of infants, especially premature infants (premies), is critical to proper anatomical growth and development. Therefore, the subject device is very useful as a positioning tool in order to provide the specific function of correctly positioning the premie's joints and muscles, while concurrently providing the fetal position (nesting) elements of being contained or tightly swaddled.

In addition, the cotton harness portion of the subject device provides the opportunity for internal rotation, flexion and extension of the joints of the child while at the same time maintaining correct anatomical alignment of hips, knees, ankles and feet. The soles of the feet will be supported by the U-shaped roll of the cradle (preferably also lambskin) which provides a firm surface for flexion type nesting, while at the same time serving as a firm base when the premie desires extension.

Because sensory learning is unparalleled in the first six months of life, natural lambskin is the ideal medium for tactile experience. Because sensory learning and positioning of the child are theorized as critically impacting growth and development, it is important that premies are exposed to appropriate sensory learning experiences and correct positioning. The subject device is to be used with the premie on his tummy or his side; it is not recommended for use with a back-lying premie. This therapeutic tool is suggested for specific use with the "growing premie", although it may prove effective with the acute respirator premies, also.

The preferably 100% natural cotton harness is positionable via velcro tabs. Once the premie is positioned, his feet will rest against the U-shaped pad when he is in the fetal position. His head will also be in contact with the lambskin at all times. The velcro tabs on the side of the U-shaped pad are used to secure the top portion of the harness and can be adjusted to draw in the longitudinal side walls of the "cradle", thus tightening the "nest".

If necessary, the device may be secured to the mattress pads so it will not travel down to the bed's foot. The U-shaped, upstanding, side wall or roll of the cradle is to contain the premie and help him stay in the "nest" and not slip out of the harness, thus preventing the child traveling down to the foot of the bed. Even when the bed is at an incline, the cotton harness and U-shaped, upstanding side wall or roll are designed to contain the premie adequately in the general center of the bed.

The subject device is to be "spot-cleaned" when drooling, dribbling and reflex spitting occur. It is not sensorially advantageous to always put a cloth under the premie's face. This may keep the cradle cleaner, but it seriously diminishes the premie's tactile learning opportunities. It is suggested that the device be spot-cleaned with a dry cloth as often as necessary with readjustment of the premie's position so that the damp spot can air dry. When premies are placed into the subject cotton harness, they need to be wearing a diaper. If stooling soils through the diaper onto the harness, the harness can be changed. If stool has stained the lambskin, one may try "spot-cleaning" with a dry cloth, then a slightly damp one to remove the remaining stain. The subject device is preferably made from treated, washable lambskin.

Each premie should or must has his own subject device. This is a transitional object specific to each individual baby. Because it is baby specific, it should not go through the hospital laundry service. Rather, it should be taken home and washed by the parents. Washing may be done by hand, or in the washing machine with one tablespoon liquid dish soap on a gentle cycle. It is best to air or line dry the subject device, but drying in the dryer on a gentle air cycle is also acceptable. The preferably 100% cotton harness may be cleaned as other white diapers are, that is, generally machine washed, bleached, and dried. Once dry, the subject device, on its upper operating face, needs to be brushed with a natural bristle brush to remove loose wool fibers. Any loose fibers also may be removed by hand.

BRIEF DESCRIPTION OF THE INVENTION

The subject device is basically made up of some three elements:

(1) A flat, elongated U-shaped base or floor member preferably made up of a lambskin with the wool thereof upwards and the skin thereof downwards. This base or floor member is intended to lie flat on the sheet or cover on the mattress in an isolette for a premature baby. The open end of this device is referred to as the "upper" end thereof and the closed end of this device is referred to as the "lower" end thereof. ("Isolette" is a term referring to a baby bed, with attached medical accessories and perhaps a cover or hood, constructed, designed and with associated medical devices to care for a prematurely born infant.")

(2) A ruff or collar of horseshoe or U-shape which is attached to the lower end or U periphery of the base lambskin. This collar or ruff comprises in part an external or outer elongate strip of cotton cloth which is secured at one inner edge thereof to the lower edge or U end edge of the base or floor member. The inner portion of the ruff or collar is an elongate strip of lambskin secured at its side edges to the side edges of the cotton cloth outer strip. The wool side of the inner portion of the ruff or collar extends inwardly toward the center of the base piece, with the skin side outwards facing polyfill which faces cotton. The external elongate rectangular strip of cloth vertically surrounds the periphery of the ruff or collar with the lower end thereof secured, together with the inboard lower edge of the lambskin strip to the outer edge of the floor or base lambskin, the upper end of said cloth member being secured along its length to the upper outer edge of the lambskin strip.

(3) There is, further, a loin cloth-like harness adapted to receive the diapered portion of the infant. One lower side of the loin cloth lies on the lamb's wool surface of the base or floor member, the other upper side being attachable, at extended waist ends thereof to velcro patches affixed to the outside of the vertical cloth strip on the outer side of the collar or ruff adjacent the free U-ends thereof. The lower side of the loin cloth has cloth extensions thereof that pass through slots provided through the base or floor member lambskin and may be fixed, removably, to velcro patches provided on the underside of the base or floor member. By providing a plurality of slots spaced from one another with intermediate strips of velcro therewith, the harness can be adjusted along the floor of the base or floor member to best accomodate the premature infants actual size. The smaller the infant, the closer the harness will be to the closed or U-end of the ruff or collar and the base or floor member.

In this device, the very young baby (premie or prematurely born infant) is to lie on its stomach with its legs and feet received in the arcuate closed end of the U ruff or collar. A premature infant has very weak muscle tone and thus this device is a container for the infant's body (within the ruff or collar) at least from the waist downwardly and, in most cases, from the shoulders downwardly. That is, the infant's stern is received (such is diapered) within the loin cloth-like harness with the infant's legs and feet extending therebelow into the closed end of the U part of the collar or ruff.

The device, being very comfortable and comforting, to the child, further affording support to the infant's legs and feet by the ruff, as well as the infant's arms, also provides tactile simulation from the lambskin to the infant's feet soles and lower legs, as well as arms, palms of hands and face.

The harness or loin cloth is longitudinally adjustable along the floor and collar of the device. As above noted, there are slits provided in the base or floor piece of the device with (underside of the skin) velcro strips adjacent thereto. Two tabs are provided on the outside of the lower side or portion of the harness or loin cloth, which tabs may be selectively inserted through the pairs of slits and engaged with such velcro patches, the tabs themselves having mating pieces of velcro thereon. There are further elongate velcro strips on the vertical outside surface of the cloth member connecting to the outer edges of the lambskin part of collar or ruff. These strips are engageable by velcro strips on the side extensions of the upper part of the harness or loin cloth. Thus, the bottom and top portions of the harness or loin cloth are separately longitudinally adjustable from one another or with one another both on the base piece and the ruff or collar.

Typical but not limiting dimensions give an idea of scale of the device. A preferred length of the floor piece lambskin may be about 19 inches. The width thereof may be about 10 inches. The length of the collar or ruff along the longitudinal sides of the base piece may be approximately 14½ inches on each side. The collar or ruff may extend, typically, about two inches high above the base piece. The depth of the loin cloth on each side from the waist to the crotch may be about 6 inches.

THE PRIOR ART

Applicant has not been able to find any device for use with prematurely born infants in any way closely resembling, functioning as or suggestive of the subject invention and construction. In searching, the following patents were noted by the searcher:

Perl U.S. Pat. No. 1,583,419 "Sleeping Bag Device", issued May 4, 1926;

Padolsky U.S. Pat. No. 1,637,088 "Pad For Infants" issued July 26, 1927;

Petrescu U.S. Pat. No. 1,678,125 "Sleeping Bag" issued July 24, 1928;

Roston U.s. Pat. No. 4,383,713, issued May 17, 1983 for "Orthopedic Support Apparatus For Infants"; and Als et al U.S. Pat. No. 4,611,353 issued Sept. 16, 1986 for "Infants Garment".

The reference to the last citation (Als et al) were also examined, including:

German Pat. No. 419055 of Sept. 19, 1925;

Milkes U.S. Pat. No. 2,008,919 "Infant Garment", issued July 23, 1935;

Idelman U.S. Pat. No. 2,227,751 "Combination Infants Garment And Blanket", issued January 7, 1941;

Williams U.S. Pat. No. 2,459,352 "Leg Warmer Bag", issued Janaury 18, 1949;

Junghans U.S. Pat. No. 2,538,420 "Bag Type Service Blanket", issued Jan. 16, 1951; and Sheahon U.S. Pat. No. 3,739,399, issued June 19, 1973 for "Neonatal Wrap".

The Examiner's attention is further directed to the Nor Lamb "SnuggleSak" characterized as "The classic Norwegian Baby-Sekk, Used By Artistocratic Families For Generations . . . ". The address of this company (Nor Lamb) is 1919 Pensylvania Avenue, NW 300-M, Washington, D.C. 20006. A print of the advertisement of this product will be supplied to the Examiner of the case as soon as the filing information is received in hand or shortly thereafter.

GENERAL INTRODUCTORY REMARKS

The subject device and development has for its purposes positioning the premature infant and correcting the position of the premature infant. It is rarely if ever used with such infants positioned on their backs, as premature infants placed on their back will choke.

The device is thus a therapeutic positioning tool. However, not only is it therapeutic, it is also protective and supportive. One positioning purpose is to keep the premature infant from sliding to the bottom of the baby bed or isolette or migrating to the bed end or corner. The latter purpose involves an important problem because premature infants are postioned, in hospital, on an incline with the baby's head higher for the purpose of postural drainage. This angle of the supporting surface may be as much as 30% to 45%. Because mucus and fluids tend to collect in the premature infant's lungs, positioning the body of the child at an angle with its head up minimizes choking and posturally enhances natural drainage. Premature infants going home from the hospital still will be positioned to lie head up.

Normal newborn infants of 6 to 10 pounds or more are also quite likely to be put into this device. One can use the device for normal infants, but they grow out of it quickly. On the other hand, a 1 to 5 pound premature infant may take as much as 8 months to grow out of the subject device or, alternatively, more quickly. The device can be used until it is outgrown by the child, or until swaddling or nesting is no longer the developmental need of the infant.

One definitely wants the baby's face on the wool of the base lambskin. The device can be used with the head of the infant extending past or off of the top end of the lambskin, but most preferably not. The device may be made as long as necessary to keep the infants head on the base lambskin. The length/width ratio is typically about 2 to 1 (longer than wide).

Another important purpose is to cradle and nest the premature child. The device should be constructed to be and/or adjustable tight enough and small enough around the child to give a definite nesting effect. Additionally, the subject device is to help the premature infant's postural development, for postural drainage and joint alignment.

With respect to the walked or raised sides and lower end wall (a continuous U or horseshoe configuration), such wall or roll is preferably long enough that the baby's arms are normally positioned inside the end ridges of the U or horseshoe wall construction. Optionally, if it is desired or necessary, the vertically raised side wall portions of the device may be drawn inwardly toward one another for very small babies and held in that position by the adjustability of the harness with respect to the device itself.

One diapers the premature infant before it is placed into the device and is engaged within the harness of the device. Each device will preferably be provided with several cotton harnesses of different sizes to allow for growth of the child.

The use of lambskin for the base panel or sheet with the wool positioned upwardly is optimal to provide the desired tactile effect. Yet further, the provision of lambskin on the upper and inner sides of the horseshoe wall or roll is optimal for the tactile effect. While the invention is useable with the lambskin replaced by artificial fur and/or cloth, such alternative materials are nowhere near as desirable and useful as the actual natural fiber lambskin uses as herein described and shown.

For the outer panel of the wall attached to the periphery of the base panel, 100% cotton is used for allergenic reasons. There is a polyfiber filling of the tube (lambskin/cotton wall portions) of the wall which is fixed to portions of the periphery of the upper surface of the floor or base panel, sheet or skin. This filling is typically 100% polyester. Velcro panels are positioned along substantial portions of the outer side lengths of the wall and, as well, on the underside of the base lambskin between the sets of adjustment slits and further, longitudinally along the side of the former.

The entire device is 100% washable and dryable. The cotton and fiberfill dry quickly. The subject device most probably will or would be lost in hospital laundries. The parents of the baby should own it and take it home to clean it and wash it and return it to the hospital when necessary.

A strip of cotton cloth (for example two inches wide) may be provided along the open end of the device fastened to the base lambskin for securing the device in desired position in the sloped isolette or inclined bed. Alternatively, tags may be supplied at various positions along the head end length. What such fixing means is that the enclosing U-shaped wall, particularly including the bottom portion of the roll thereof, causes the premature infant to always be located in the center of the bed despite the incline without permitting any improper change of location for the childs body or the device itself.

OBJECTS OF THE INVENTION

A first and primary object of the invention is to provide an improved receiving, holding, containing and snuggling device for a prematurely born infant.

Another object of the invention is to provide a premature infant bedding construction which is remarkably new in its structural configuration and further provides substantial new concepts for and/or results in the proper and optimum treatment, maintenance and preservation of prematurely born infants.

Yet another object of the invention is to provide a small bed or bedding device or construction for use with a prematurely born infant, which device safely and most comfortably receives the "premie" child therewithin, positively engages the diapered child into the device with a loin-cloth like harness, further receiving the legs and a considerable portion of the infant's upper torso, preferably including the arms within a comforting padded, resilient wall for safety and comfort's sake, as well as sensorially useful tactile experience. Additionally, the engagement of the infant engaging harness may be so varied as to readily adapt to various sizes of prematurely born infants.

Another object of the invention is to provide a bedding device which safely and substantially completely holds and confines a prematurely born infant in a mattress/surround construction that entirely obviates and prevents any tendency of the premie (because of its motion -naturally seeking the tightness of "nesting" walls found when at the foot of the bed- or the normal slope of the isolette in which it is received) from moving from a preselected position on the bed or isolette mattress. This devices does not permit the infant to slide or move to the bottom of the sloped isolette or bed and yet meets the premie's need to be tightly confined-snuggled like he is when he is at the bottom of the bed.

Another object of the invention is to provide such a described new device for receiving, holding and protecting prematurely born infants in a manner that enables the continuous contact of the benign wall surface of lambskin in continuous contact with the premie, thereby to provide sensorially advantageous experiences in the area of olfactory and tactile learning at the earliest possible age. Sole of feet, palms of hands, face and mouth are the most sensitive to tactile stimulation thus receive greatest sensory advantage.

Yet another object of the device in question is to provide means, apparatus and devices for optimally positioning prematurely born infants in order to secure their proper and optimal anatomical growth and development, the device in question automatically correctly positioning the premature child's joints and muscles, while concurrently providing the fetal position "nesting" elements of being contained or tightly swaddled.

(In this device the adjustable cotton harness portion receiving the infant's diapered fundament provides the positioning opportunity for internal rotation, flexion and extensions of the child's joints, while at the same time, maintaining the correct anatomical alignments of hips, knees, ankles and feet. The soles of the child's feet (being supported by the U-shaped roll or wall of the bedding device) have provided therefor a firm surface for flexion type nesting, while, at the same time, serving as a firm base when the premie desires extension.)

Another object of the invention is to provide such a bedding tool for premies such as to always be used for and to maintain the premie optimally on his tummy or his side.

Yet another object of the subject invention is to provide such a described device which permits effective adjustment of the position of the harness with respect to the bedding base pad and, additionally, further allows inward drawing or outward relaxation of the U-shaped retaining wall, collar or roll. Drawing in the partially infant surrounding walls more tightly nests the child, while releasing such outwardly permits more room for the growing premie. This allows for specificity according to the individual infant's needs, it is flexible to the body specific.

Other and further objects of the invention will appear in the course of the following description thereof.

THE DRAWINGS

In the drawings which form a part of the instant specification and are to be read in conjunction therewith, an embodiment of the invention is shown and, in the various views, like numerals are employed to indicate like parts.

Figure 1:
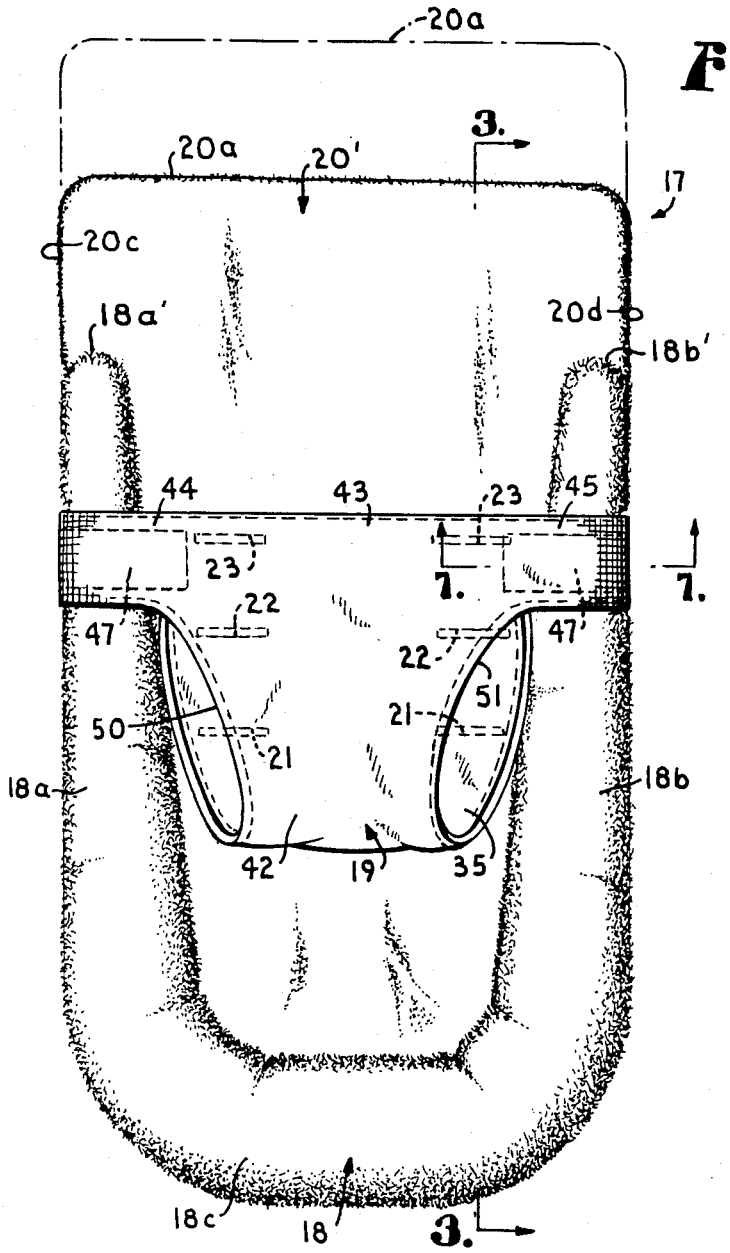
FIG. 1 is a top plan view of the device with an infant not positioned therein, the infant's bottom receiving harness being positioned essentially at the middle adjustment on the bottom flap of the harness.
Figure 7:
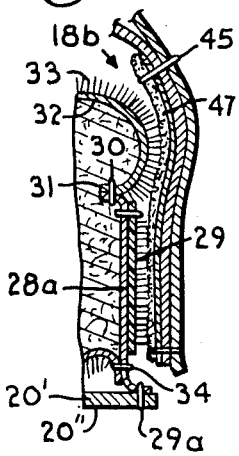

FIG. 7 details the engagement of the harness strap with the side wall velcro patches and is a view taken along the line 7—7 of FIG. 1 in the direction of the arrows.

Figure 8:
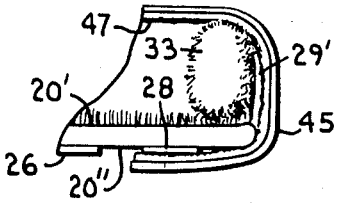
Figure 6:
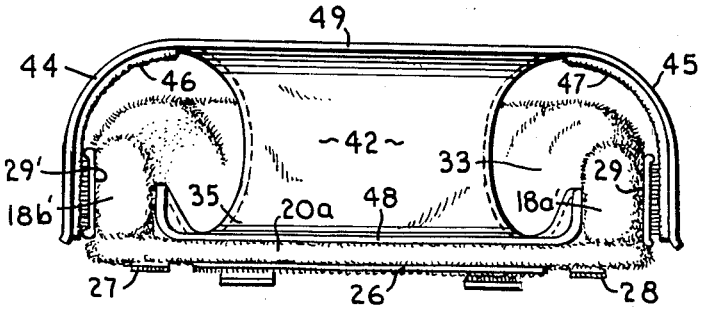
FIG. 6 is a head end view of the subject device.

FIG. 8 is an end view like the right hand side of FIG. 6 but with the harness engaged past the side velcro to reach and also engage a velcro strip on the underside of the pad.

FIG. 9 is a three-quarter plan view or elevation of the harness to be used with the bedding device showing the shape thereof, as well as the position of the velcro strips on each end thereof.

FIG. 10 is a front view of the subject device inverted for use in an infant car seat.

FIG. 11 is the same view as FIG. 10 but with the child removed from the view.

FIG. 12 is a three-quarter frontal perspective of the said car seat with the said bedding device positioned therewithin before the infant is inserted into the car seat and with the tray of the carseat elevated to permit the infant to be inserted.

FIG. 13 is a vertical section through FIG. 11 along the line 13—13 of FIG. 11 in the direction of the arrows with the single change that the lower center belt and buckle are engaged with the underside of the tray.

STRUCTURE AND FUNCTION

Referring to the drawings, the subject device is essentially made up of three parts, that is, specifically, a base pad 17 which is preferably a lambskin with the wool side up, a retaining wall 18 positioned on the top periphery of the base pad, enclosing the lower or foot end of the pad as well as considerable lengths of the side edges of the pad and, finally, a harness 19 removably attachable to the base pad 17 and the side walls of the retaining wall 18, such harness 19 adapted to receive the diapered fundament of the premature infant. Each of these three main portions of the subject device has structural details which will now be called out.

The base pad is generally designated 20 (as well as 17). This pad is optimally a lambskin piece having an upper wool side 20' and a lower skin side 20''. Alternatively, this pad can be fabricated of artificial fur (again with the fur side up and the skin side down) padded cotton or the like. It is far preferred and a more useful and advantageous to have the base pad (20, 17) be a lamskin as described.

Base pad 20 has a normally top or upper end **20*a* which preferably but not necessarily essentially comprises a straight line normal to the longitudinal axis of the base pad, such top end optionally having rounded corners thereat. The foot end 20*b* of the pad is preferably arcuate or rounded. Side edges 20*c* and 20*d* of pad 17, 20 are preferably substantially straight and parallel until they reach the arcuate end 20*b*, extending substantially normal to top side 20*a*. Thus, base pad 20 is substantially rectangular length of wool side up lambskin with a preferably straight top edge 20*a* and a most preferably arcuate rounded bottom edge 20*b* with elongate, substantially parallel sides 20*c* and 20*d*. A typical length/width ratio would be 2 to 1 with, say, a 19 or 20 inch length for base pad 20 and a ten inch width. FIG. 1 shows in dotted lines how the length of the pad may be extended from the top edge onwardly, if desired. The length of pad 20 above the harness 19 (to be described) is most preferably such as to permit and ensure the child's head is on the base pad 20**.

Figure 4:
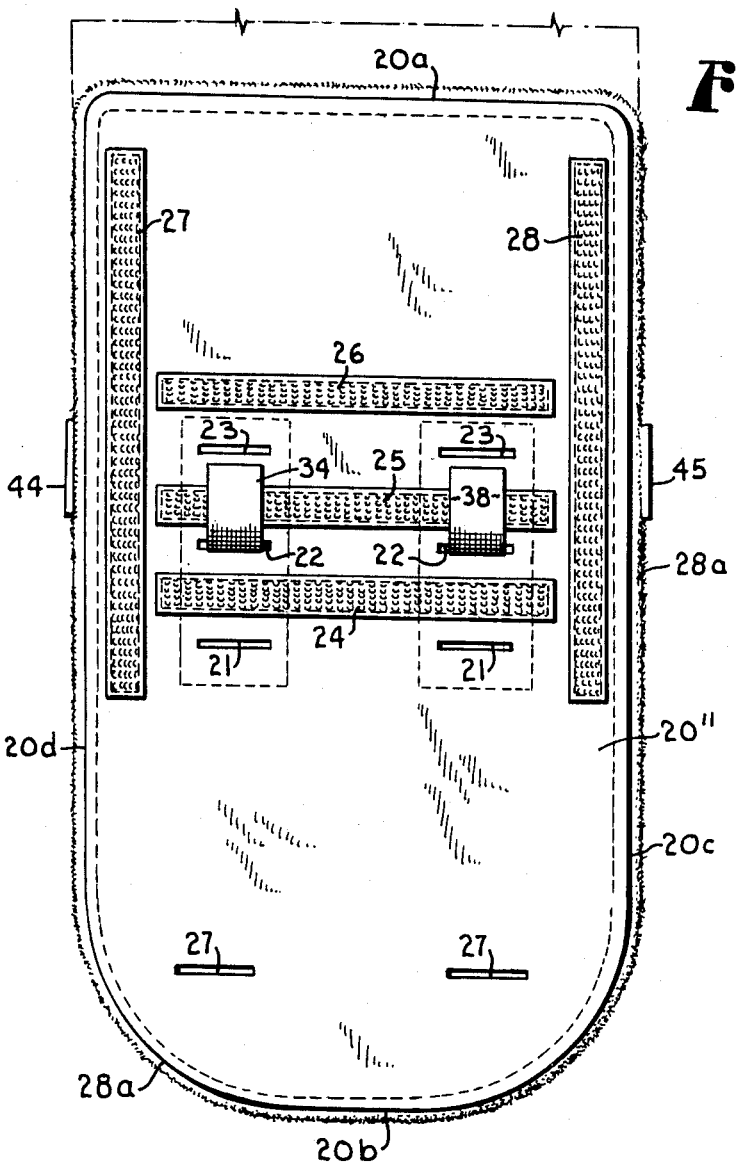
FIG. 4 is an underside view of the device of FIG. 1. (In both FIGS. 1 and 4, a dotted line base pad extension is shown as possible for the head end of the subject device.)

Referring to FIG. 4, three sets of slots 21, 22 and 23 are provided through the wool and skin of base pad 20 (or whatever material it may be constructed of), each pair of slits 21–23, inclusive preferably being spaced equal distances from one another on the same level "laterally" and also "vertically" with respect to the top **20*a* and bottom 20*b* ends of the base pad. Transverse, parallel velcro strips 24, 25 and 26 are sewed or otherwise fastened on to the underside (skin side) of base pad 20 and are spaced upwardly, respectively, from the sets of slots or slits 21, 22 and 23. Longitudinal velcro strips 27 and 28 are most preferably positioned along the pad side edges 20*c* and 20*d*, such spaced inwardly somewhat from the side edges 20*c* and 20*d*. A fourth pair of slits 27 are preferably provided fairly close to the bottom edge 20*b* of lambskin or base pad 20, but inwardly from the retaining wall 18** for purposes to be described.

Referring now particularly to FIGS. 1, 3, 5, and 7, and retaining wall 18, an outer peripheral panel 28 of cotton is secured by sewing as at 29 to the periphery of the upper surface of the base pad or base lambskin 20. As may be seen in the figures, this elongate strip of cotton follows the rounded lower edge **20*b* and runs well over half (typically two thirds to three quarters) of the length of the side walls 20*c* and 20*d*. Cotton strip 28 has elongate velcro strips 29 and 29' sewed or otherwise fixed to the substantial length of the straight side portions of cotton strip 28**.

At the upper edge of the elongate cotton strip 28, a sewed closure 30 is made to the upper inboard edge 31 of an elongate horseshoe shaped tube or length 32 of lamskin (artificial fur or padded cotton, etc.) having an outer wool side 33. The sewed connection 30 between the upper edge of the lambskin member 32 and strip 28 may be seen both in FIGS. 3 and 7, while the lower sewed closure 34 of the lambskin length of the elongate enclosing wall may also be seen in these figures. The volume within cloth strip 28 and lambskin 32 is filled with a cushioning substance preferably a (polyester fiber fill) dries quicker than cotton.

Turning to the harness which is seen from the outside in FIG. 9, this device has a funnel shaped base portion 35 with a folded over upper edge portion 36 stitched to itself at 37 and across the bases of elongate velcro strips 38 and 39 as at 40. In FIG. 9, the viewer is looking at the outer side of the device (away from the child to be enclosed or received therewithin). The harness device makeup is preferably two sheets of 100% cotton cloth of the same configuration sewed to themselves at the peripheral edges thereof as seen at 41. The reduced width portion of the harness which passes under the crotch or perineal area of the child is seen at 42. The upper panel 43 of the harness, which, in FIG. 2, may be seen as overlying the child's lower back, has elongate side arms 44 and 45 formed therewith. Velcro strips 46 and 47 are provided on the opposite sides thereof than velcro strips 38 and 39.

Figure 2:
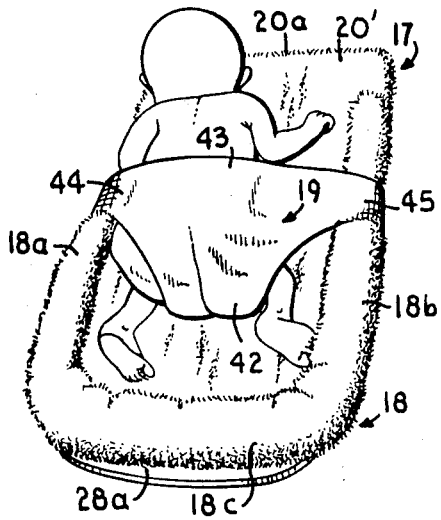
FIG. 2 is a three-quarter view of the device of FIG. 1 showing a small premature infant received on the bedding device with the diapered portion of its body received in the retaining harness.
Figure 3:
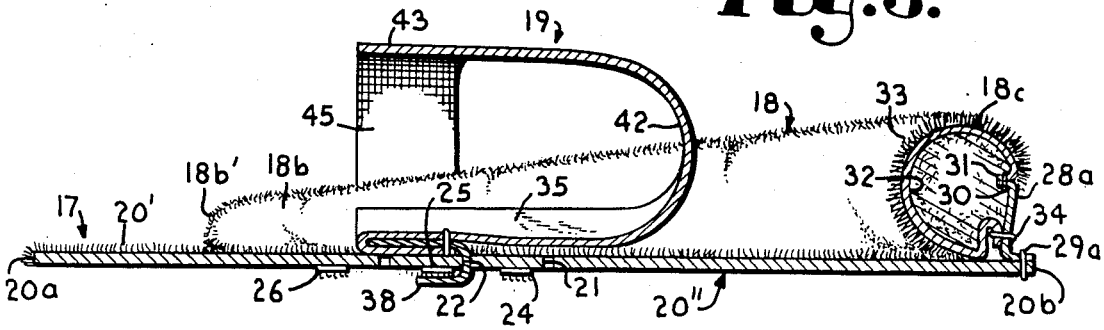
FIG. 3 is a view taken along the line 3—3 of FIG. 1 in the direction of the arrows.

Still referring to the harness detailed in FIG. 9 but also seen in FIGS. 1–3, inclusive, 5 and 6 (without fragmentation thereof), typical (but not limiting) dimensions of the subject device may again be received. Thus, a preferred length of the base pad or floor piece member or lambskin may be about 19 or 20 inches. As may be seen in FIG. 1, either the head length of the lambskin (base pad) may be extended several inches or, alternatively, the dotted line portion **20*a*** can be a cloth strip sewed to the underside of the base pad which may be safety pinned to the mattress of the baby bed or isolette in which the subject device is used. Because the mattress or top surface of the baby bed or isolette, for premature infants, is tilted 15° to 45°, most commonly 30° to 45°, a securement of the upper or head end of the subject device to that mattress or surface is most desirable (necessary) so that the movements of the infant in the harness and on the base pad, confined somewhat by the upstanding wall, will not cause the device to work off axial alignment in the isolette or down to the lower, foot end of the isolette.

Figure 5:
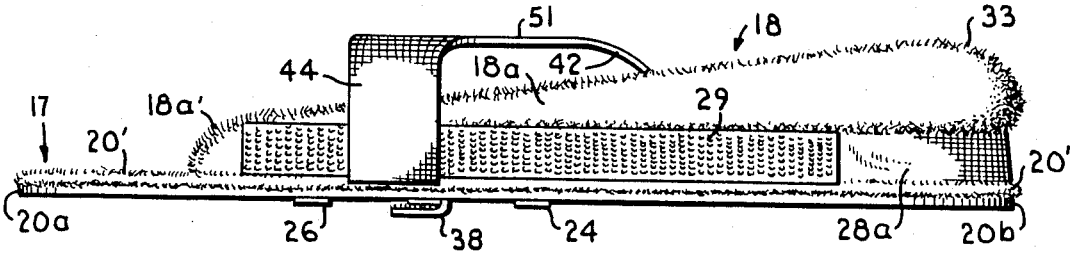
FIG. 5 is a side view of the subject device somewhat analogous to the drawing of FIG. 3.

The width of the actual base pad 20 (17) is typically about half of the length thereof or around 10 inches. While the upstanding hollow tube wall 18 is shown in the drawings as essentially positioned within the bounds of the top surface of the base pad, in actual fact, with the fiberfill stuffing of the hollow tube and the nature of the connection as seen at the right hand side of FIG. 3 and in FIG. 7, a portion of the transverse horizontal width of the side arms the upstanding wall may extend outside the periphery of base lambskin 20 (17). However, the inboard, central, lowermost portion thereof is almost always directly substantially positioned over the enclosed wool side of the lambskin inboard of connection 29 because of arms **18*a* and 18 be holding it vertical. As will be described, the application of the harness 19 as particularly seen in FIGS. 1–3, inclusive, 5 and 6 operates to draw inwardly the side, longitudinal elongate portions 18*a* and 18*b* of the upstanding wall, where the harness strap portions 44 and 45 overlie the top and outer sides of the upstanding wall lengths 18*a* and 18*b*. The height of the foot portion of the upstanding wall in any case (because it is pulled naturally into an upward position by the connection thereto of the longitudinal lengths of said side portions upstanding wall), is preferably about 3 inches. When the free end adjacent portions of the longitudinal wall portions 18*a* and 18*b* are not engaged by the harness velcro strips 46 and 47 as will be described, the height of the said longitudinal portion will run from 3 inches down to about 2 inches, typically. However, when the infant is harnessed into the device as will be described, the free ends of the upstanding wall being pulled inwardly by the velcro engagements, typically will rise to a height of about 3 inches like the foot end thereof. Alternatively the upstanding wall can be tapered downwardly in use height from the foot end to the head end thereof from about three to about two inches (FIGS. 3 and 5**).

While, typically, two or three harnesses will be provided with each base pad construction (base pad plus integral upstanding wall), these preferably being of differing size with respect to the slowly or rapidly growing infant, all of them will have the substantial structure seen in the drawings and just described. A typical length of an infant harness from edge 48 on panel 35 to edge 49 on panel 43 is approximately 14½ inches. A suitable maximum width for panel 35 would be 10¼ inches. A suitable maximum width for panel 43 (in the zone of velcro patches 46 and 47) would be 17¼ inches. A typical width of the perineal or crotch portion 42 at the least width thereof could be 4 inches.

It is understood that the purpose of giving these dimensions is to disclose the relative scales of a single, actual, working, tested device of the character described so that typical relative dimensions of these parts may be understood with respect to one another. Velcro strips 38 and 39, in the specific embodiment being talked about or written about are 4¼ inches in length. A typical length of velcro strips 46 and 47, again in the example being discussed, would be 4½ inches. The side velcro strips 29 and 29' (see FIG. 5) may range from, typically, 6 to 12 inches.

Referring to FIG. 4, slots 21–23, inclusive are typically an inch and a half long and may be separated from one another, typically, around 2½ inches. The illustrated sets of slits 21–23, inclusive may be a little over 2 inches apart centrally thereof. The velcro strips 24–26, inclusive are typically approximately 6 inches long. Distances between centers thereof are preferably approximately 3 to 3½ inches. The width of all the velcro strips described so far may typically be approximately 1 inch in width or somewhat greater. The length of velcro longitudinal strips 27 and 28 (FIG. 4) are typically 9 to 10 inches or somewhat less if the longitudinal wall arms **18*a* and 18*b*** are shortened somewhat.

The left hand edge of the harness in FIG. 9 is numbered 50, while the right hand edge thereof is numbered 51, both for the entire length thereof, from opposite edges 49 and 48.

The way that the harness is employed with given size premature infants is as follows. It should be understood that a three pound or less premie may be some twelve inches in length, six inches of which are legs, the rest torso and head. In this case, with the smallest premature infants, the velcro strips 38 and 39 are employed to extend through (downwardly through) the lowermost pair of slits 21, thereafter being turned forwardly to engage, with the ends thereof, adjacent transverse velcro strip 24. Thus, it is assumed that the smallest premature infant will have the shortest legs and, since it is most desirable that the infant's legs be received in the arcuate portion 18c of upstanding wall 18 in a manner permitting foot and leg wall 18 contact for tactile sensorially advantageous purposes.

This smallest premie position is not what is shown in FIGS. 1, 2, 3, 4 and 5. These views show the velcro strips 39 and 39 extending through the center slits 22 and turning upwardly therefrom (toward the head end) to engage transverse velcro strip 25. This would be the position for the midsize premature infant approaching 4 pounds as opposed to the smallest premie. (It should be understood that one, two, three, four or more sets of transverse slits with adjacent transverse velcro strip may be used in this device.)

The free wall arms 18a and 18b are preferably substantially longer with respect to the position of slits 23 so that the relationship of upper panel 43 is substantially as illustrated in FIGS. 1, 3 and 5 where the velcro strips 46 and 47 thereof can engage the outer upstanding wall velcro strips 29 and 29' at substantially the same position with respect to end 37 and panel 35 where upper arms 44 and 45 essentially cover the quadruple thickness cotton sheet in the upper zone thereof roughly from line 36 to end 48.

It should also be noted that the length of velcro strips 46 and 47 permit an engagement thereof with wall side velcro strips 29 and 29' from a relatively loose or open position which lets the free ends of elongate portions 18a and 18b of the tubular wall 18 (near the free ends thereof) sag outwardly to their substantially lowest height of about, say, two inchees or pull such in to a substantially vertical position as seen in the end view of FIG. 6, looking from the left hand side of FIG. 5 to the right therein. The lambskin ends 18a' and 18b' there can be seen in substantially vertical position but, in this case, in a device shown as having a naturally sloping forward wall (from say 3 inches to say 2 inches) from the foot end to the head end of the upstanding wall the transition in relaxed height at the ends 18a and 18a' will be from less than two inches to about two inches. It is preferred to have wall 18 of substantially uniform height of three inches or so. The upstanding wall length 18a and 18b may alternatively be so drawn in with respect to the length of arm portions 44 and 45 that (FIG. 8) the velcro carrying portion 47 of arm 45 passes completely down around the side velcro panel 28 (engaging it) and under the device to engage, at least with the end thereof, elongate side and underside velcro strip 28. The effect of this shortening (in effect) of the upper portion of arm 45 is to either fully pull the longitudinal arm portions 18a and 18b to a fully vertical position (FIG. 8) or substantially further lean them in at the engagement zone (not shown) so as to measurably lessen the width or distance between the inboard faces of wall lengths 18a and 18b so as to more tightly nest the premie. The same action may be taken simultaneously on the opposite side of the device with respect to arm 44 engaging longitudinal velcro strip 27 analogous to a changed (left side of FIG. 6).

In order to attach the harness of FIG. 9 with respect to the device of the earlier figures, the base panel backside 35 in FIG. 9 is placed downwardly against the wool upper surface 20' of lambskin 20 and the velcro strips 38 and 39 (on the backside of panel 35) threaded through one set of the openings 21–23, inclusive as described, being retained therein by the velcro strips 38 and 39 thereon engaging one of the velcro strips 24–26, inclusive on the bottom or backside of the base pad 20. The diapered child may then be laid on the inside of panel 35. Then the upper inside of panel 43 is adjusted in position over the child by velcro strips 46 and 47 being engaged along vertical standing velcro strips 29 and 29' (FIGS. 5–7, inclusive). This application is preferred to engaging the child in the harness after it is fully attached to the base pad. Once a position is selected for the lower panel 35, it is easier to adjust the upper panel 43 with respect to velcro strips 46 and 47. However, if the premature infant is not harnessed correctly, whatever the position taken with respect to arms 44 and 45, then the position of the lower panel 35 should be readjusted with respect to strips 38 and 39 extending through another set of slots. It is most desirable that the infant be enclosed up to its shoulders within longitudinal wall portion 18a and 18b. It is also most desirable that the knees, and/or lower legs and/or feet of the premie be able to contact the inner wall lambskin portion 33 for pleasurable tactile sensations as well as those obtained by the thighs, chest, arms and face of the infant with respect to the top surface of preferred lambskin 20 (17).

The upper portion of the base pad is preferably open at the sides for optimum air circulation to the baby and easy visibility of the child's entire head by the ICU nurse and/or parent. The child can breathe in the wooly side 20' of the lambskin where the wool is typically ¾ of an inch or an inch in length.

Now looking at FIGS. 10–13, inclusive, therein is shown a typical (not limitingly specific) automobile seat insert for a typical full term size infant or premie of five punds ready for hospital discharge. This chair or seat has back 60, somewhat enclosing side walls 61 and 62, seat 63 and hinged tray 64 on arms 64a as may be seen in FIGS. 11—13, inclusive. Over the shoulder straps 65 are connected at their upper ends to retaining means 65a within the seat structure, pass through the center wall 60a of the seat and loop downwardly to a lower end connection to a three part metal plate 66 (particularly see FIGS. 11 and 12). Center (crotch) strap 67 has buckle 68 thereon adapted to removably engage downwardly extending flange 69 on plate 66 to which the lower ends of body straps 65 are attached. As can be seen in the sectional view of FIG. 13, strap 67 is typically secured into the inner structure of seat 63 as at 70. All of the construction that has herein been already described with respect to FIGS. 10–13, inclusive is entirely conventional and is generally utilized as conventionally may be required or desired with full term size infant.

However, by reversing the direction of the premature infant's position within the subject premature infant bedding construction, another use of the instant device may be provided whereby the five pound discharge premature infant, or at least the older heavier premature infant may be carried in such a normal child's car seat utilizing the inverted subject bedding device provided therewithin.

As may be seen from the view, what is provided is that the portion of the length of the device of FIGS. 1–9 (with the harness of FIG. 9) having the elongate wall portion arms 18a and 18b thereon with the base wall 18c upwards is placed against the sloped back seat wall 60 and the straps 65 passed through parallel slits 27. Such are typically 2 inches or so from skin end 20b and may be 5 or 6 inches from the now upper edge of wall or ruff 18c. These straps 65 then, as is conventional, engage plate 66 as may perhaps best be seen in FIG. 12. The head portion of the device (normally upwards of the ends 18*a'* and 18*b'* of longitudinal arms 18*a* and 18*b*) now operates by bending at a 90° angle and lying on seat 63 as best seen in FIG. 12. The device is prepared as in FIG. 12 to receive the infant who is inserted with his bottom on the now seat wool up lambskin portion and his back against the now back arm enclosed lambskin portion with his head extending upwardly between straps 65. With the straps being separated to avoid scraping the infants head, the pivotal tray 64 on arms 64*a* is then lowered to the position seen in FIG. 10, 11 and 13. At this time, buckle 68 may be engaged with perforated flange portion 69 to complete the enclosure of the premature infant in the seat but received within his lambskin for essentially his entire body except the legs below the knee thereof.

Thus it may be seen that the bedding device of FIGS. 1–9, inclusive yields itself to yet another useful function by the repositioning thereof in the manner seen in FIGS. 10–13, inclusive and the provision of slits 27.

FURTHER GENERAL REMARKS

Referring to the drawings, and particularly FIGS. 1 and 4, preferably the foot end of the top side of upstanding wall 18 (18*a*, 18*b* and 18*c*) is more arcuate than is shown in the views. Bending an arcuately configured lambskin or a sheepskin in the manner seen in FIGS. 1 and 4, and even if the skin is essentially rectangular, with the cotton/lambskin wall/lambskin floor structure of FIGS. 3 and 7, the wall lambskin strip will typically become arcuate and also typically extend out over the side and end edges of the lambskin pad. This is because (see the right hand side of FIG. 3), the lambskin is considerably stiffer than the cotton wall portion 28, especially where the velcro 29 and 29' is not supplied and thus the cotton strip 28 tends to lie down more horizontally outboard of the skin 20 or base pad which tries to return to its original shape. Also, the filling of the two wall elements tends to make the entire transverse section of the tube round, including the cotton wall portion.

An optimum lambskin or sheepskin for use in the subject device is what is called a yearling lamb or sheep which has been sheared once or a "shearling". This results in the wool depth typically being three quarters to one and a quarter inches. The subject lambskin device (or sheepskin) has to have some pile. It is preferably undyed. A quarter inch long wool pelt is, in general, too bristly. When one gets up to the two and two and three quarter inch long piles, the device is measurably harder to sew and manufacture. Even these pile lengths are safe, due to the nature of wool (breathable through), but most mothers are too apprehensive of suffocation or asphyxiation to readily use such longer wool fiber skins. Also such longer fiber or pile may obscure more of the infant's face than desired. Accordingly, as noted, typically, three quarters inch to one and a quarter inch pile height is optimum from manufacturing needs (sewing), pleasantness in tactile sensation to the infant, in appearance to the parents and for visilibity to nurses et al.

In an upwardly sloped isolette or infant's child's bed, without securement of the child to the center of the bed, it will very much tend to purposely migrate to the bottom wall corners of such to "nest" as much as possible against the walls. This migration, repeated over and over, wastes energy which is needed for growth and is saved by the subject device.

The technical definition of a premature infant is one which has had less than 36 weeks gestation. It should be noted that today, 1987, some children are being saved for life by, typically, caesarian section at as early a date as the 27th week of gestation, (1) which is very many weeks early for a normal birth. Such an infant may be only one pound in weight. Very typically, if such a child is in able to survive, it well may be in the ICU several months. Typically, the shortest hospital stay of a premature infant delivered at 30 weeks would be a month. Those delivered in the interval from 30 to 36 weeks gestation may typically stay in the ICU two weeks or more.

It should also be noted that all infants tend to lose 5 to 16 ounces at birth due to the stress of birth. They must catch back up on this weight. Infants released to go home from the hospital are usually at least 5 pounds in weight.

Very young and very life threatened premies tend to develop stron aversive reactions to the approach of nurses because of all the needle sticks, etc. they must endure, including heel and finger sticks and IV lines to their heads and hands. With such infants, this device may be quite important in furnishing readily available comfort, cuddling, nesting places and surfaces and the like. Particularly this is true when the device is drawn intermediate the ends of the arms 18*a* and 18*b* of the upstanding wall 18 which arms are engaged in the manner shown in FIG. 8.

There is another class of children born characterized as IUGR (Intra Uterine Growth Retardation) children, whose conditions are typically due to major pregnancy stresses. Such factors, by no means exhaustive, may include (1) a heavily smoking mother, (2) a medically ill mother and/or intra uterine child, (3) drug addition in the mother resulting in the same with respect to the child, (4) excessive alcohol use by the mother and any combinations of these factors, as well as others. It is quite possible that physicians may deliberately interrupt pregnancies where there is intra uterine growth retardation in order to remove the stressed child from the mother's womb in order to give the baby a chance to grow.

With respect to this type of child, it may not be so much the size and/or weight, but also the important factor of fretfullness because of the hostile intra uterine environment. Getting the premature child out of such a hostile environment as soon as possible into the more benign subject device (particularly benign touchwise) is projected to be very helpful and useful to handle the child, give it maximal sensorially pleasurable stimulation and permit optimum cuddling and nesting of the child in the device.

Still further, it is the simple fact that teen pregnancies are rampant in the United States, as well as other countries. It is quite common for these young ladies or girls to deliver prematurely with such being more probable the younger the mother may be. There are considerable numbers of eleven year, twelve year and thirteen year pregnancies in the United States. Such facts produce numbers of premature infants and a high rate of caesarian section births because the essentially child mother pregnancy typically involves a body whose bone structure, particularly the pelvis, is not sufficiently developed that the child can be delivered normally or vaginally. It is not at all uncommon to have the combination of teen and early teen pregnancies coupled with IUGR involving smoking, drugs, alcohol, illness, poor nutrition, combinations thereof, etc.

With respect to clearing the periphery of the upper end 20*a* of the base pad between end 20*a* and side wall ends 18*a'* and 18*b'*, the essential rationale is not primarily to make sure there is no supply of air to the child. Rather, the ICU nurses must be able to, at any time, see the baby's face to determine the color thereof, whether the child is crying, whether the child is choking, etc. If this were not the case, the upstanding walls 18*a* and 18*b* could be carried either to the ends of the base pad or in a complete enclosure of the base pad, adjusting the dimensions accordingly.

Psychologically, babies, even very young premature babies, love to migrate on the isolette mattress to find surfaces to contact and nest against. The subject device offers very young infants an opportunity to obtain more control of their environment which is presumed to be good for the child's self esteem. Thus, the child can decide what to do with respect to its motions, whether to pick at the wool, mouth the wool rub its arms thereagainst, move its legs with respect thereto and to the surrounding upstanding wall, etc. This allows more choices and the making of decisions by the infant all of which is postulated as psychologically good for the child.

With respect to the use of the subject device in the manner seen in FIGS. 10–13, inclusive, the device very well may be used as such as an nesting holder within the (for normally larger infants) conventional car seat structure and can be included as a part of the hospital discharge instructions to the parents when the child is released from the hospital.

If the parents have two of the devices, one can stay in the car seat as shown and one be used for sleeping purposes. However, it must be emphasized that this device is most preferably associated with sleep by the child and, thus, if it is so used, it may be used but only a few times as a car seat tool or aid for a very small infant or child.

After the swaddling of the child ends, where the child is not engaged by the harness, the lambskin device here disclosed can be used by the child to sleep on any part thereof, such as just laying its head on the open end portion thereof. It is common and desirable for an open lambskin pad or substantially full skin, per se be used for sleep by older, larger children grown out of the swaddling stage addressed by this development.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A therapeutic positioning device for receiving and holding prematurely born infants thereon comprising, in combination:

(1) an elongate, flat base pad of substantially rectangular shape having a generally relatively upwardly positioned head end thereof and a generally relatively downwardly positioned foot end thereof, said pad ends connected by substantially straight and substantially parallel elongate side edges, said pad also having top and bottom, normally flat surfaces thereof, (2) an upstanding, resilient yet shape retaining wall positioned at and fixed to a portion of the periphery of said pad, such pad periphery portion including the entire foot end thereof and substantial lengths of the elongate side edges of said base pad, said lengths each extending from the foot end of the base pad, such wall extending upwardly above said pad top surface from said foot end thereof at least partially along the side edges thereof at the substantial periphery thereof whereby a substantial portion of the central area of said pad top surface from the foot end thereof upwardly towards the head end thereof is bounded by said wall at the peripheral edges thereof;

(3) a loin-cloth like harness adapted to receive the diapered fundament of a prematurely born infant therewithin, said harness having an upper side, such comprising a substantially V-shaped first panel and a lower side, such also comprising a substantially V shaped second panel, said panels connected together at their lesser width ends by a substantially rectangular child's perineal or crotch area underlying cloth;

(4) first means for removably fixing portions of the lower side panel of the harness to the base pad and separate, second means for removably fixing portions of the upper side panel of said harness to side portions of side lengths of said upstanding wall, and (5) said harness having both the upper and lower side panels thereof separately longitudinally adjustable and removably fixable with respect to portions of the upstanding wall and base pad, respectively.

2. A device as in claim 1 wherein the foot end of said base pad is arcuate in form.

3. A device as in claim 1 wherein the means for removably fixing portions of said lower side panel of the harness to the base pad comprises at least two slits through said base pad and extensions on said lower side panel operative to extend through said slits and be engaged removably to said base pad underside.

4. A device as in claim 1 wherein the means for removably fixing portions of the upper side panel of said harness to side portions of side lengths of said upstanding wall include elongate side extensions of the free ends of said upper side panel carrying removable engaging means thereon to engage removable engaging means fixed on and along the outer sides of said upstanding wall side lengths.

5. A device as in claim 4 including removable engaging means adjacent the side edges of the base pad underside whereby to enable drawing of portions of the upstanding wall towards one another.

6. A device as in claim 1 wherein said base pad is a lambskin with the wool side upwards as the top surface thereof and the skin side downwards as the bottom surface thereof.

7. A device as in claim 1 wherein the inner and upper portions of said upstanding wall are made up of a lambskin having the wool side inwards toward the center of the base pad and the skin side outwards therefrom.

8. A device as in claim 1 wherein said base pad is made up of lambskin with an upper wool side as the top surface thereof and the lower skin side as the bottom surface thereof and the upstanding wall is made up, in the inward and upper portions thereof by a lambskin having the wool side inwards and upwards with respect to said base pad and the skin side outwards and downwards with respect thereto.

9. A device as in claim 1 wherein said upstanding wall comprises a somewhat flexible, hollow tube in its entire length, said tube filled with resilient material.

10. A device as in claim 9 wherein said hollow tube has an upper and inner portion comprising an elongate lambskin strip with the wool side thereof outwards and the skin side thereof inwards.

11. A device as in claim 1 including a pair of laterally spaced apart slits provided through said base pad closely adjacent the arcuate end thereof, said slits extending substantially normal to the longitudinal axis of said base pad.

12. A device as in claim 1 wherein the means for removably fixing portions of said lower side panel of the harness to the base pad comprises at least two slits through said base pad and extensions on said lower side panel operative to extend through said slits and be removably engageable to the said base pad underside, the means for removably fixing portions of the upper side panel of said harness to side portions of said lengths of said upstanding wall include elongate side extensions of the free ends of said upper side panel carrying removable engaging means thereon to engage removable engaging means fixed on and along the outer sides of said upstanding wall side lengths.

13. A therapeutic positioning device for receiving and holding prematurely born infants thereon comprising, in combination:

(1) an elongate, flat base pad of substantially rectangular shape having a generally relatively upwardly positioned head end thereof and a generally relatively downwardly positioned foot end thereof, said ends connected to one another by substantially straight and substantially parallel elongate side edges, said pad also having top and bottom, normally flat, side faces thereof, (2) an upstanding, somewhat flexible, hollow tubular wall positioned at and fixed to a portion of the periphery of said pad, such positioning and fixing including the entire foot end thereof and substantial lengths of the elongate side edges of said pad extending upwardly thereon from said foot end thereof, at the substantial periphery of said pad, whereby a substantial portion of the central area of the top surface of said pad from the foot end thereof upwardly towards the head end thereof is bounded by said wall at the peripheral edges thereof;

(3) resilient material filling said hollow tubular upstanding wall along the entire length thereof from end to end;

(4) a loin-cloth like harness adapted to receive the diapered fundament of a prematurely born infant therewithin, said harness having an upper side, such comprising a substantially V shaped, first panel and a lower side, such comprising a substantially V shaped, second panel, said panels connected together at their lesser width ends by a substantially rectangular child's perineal or crotch area-underlying cloth;

(6) means for removably fixing portions of the outer end portions of the lower side panel of the harness to the base pad and separate means for removably fixing portions of the outer end portions of the upper side panel of said harness to the longitudinal portions of said upstanding wall, and (7) said harness having both the upper and lower side panels thereof longitudinally adjustable and removably fixable with respect to portions of the upstanding wall and base pad, respectively.

14. A device as in claim 13 wherein said base pad is a lambskin strip or panel having the wool side thereof normally facing upwardly as said pad top surface and the skin side thereof normally facing downwardly as said pad bottom surface.

15. A device as in claim 14 wherein said hollow upstanding wall has an inboard and uppermost portion formed of an elongate length of lambskin having the wool portion thereof outwards and the skin portion thereof inwards, the balance of said wall comprising an elongate cloth strip secured at a lower edge thereof to the periphery of said base pad, the lower edge of said lambskin portion of said upstanding wall fixed to said cloth length adjacent said last connection to the base pad and the upper end of said cloth strip being secured along the length thereof to the upper and outer edge of said lambskin portion of said wall.

16. A device as in claim 13 wherein the means for removably fixing portions of the upper side panel of said harness to said portions of side lengths of said upstanding wall include elongate side extensions of the free ends of said upper side panel carrying removable engaging means thereon to engage removable engaging means fixed on and along the outer sides of said upstanding wall side lengths.

17. A device as in claim 16 including removable engaging means adjacent the side edges of the base pad underside whereby to enable drawing of portions of the upstanding wall towards one another.

18. A device as in claim 13 wherein the means for removably fixing portions of said lower side panel of the harness to the base pad comprises at least two slits through said base pad and extensions on said lower side panel operative to extend through said slits and be engaged removably to said base pad underside, the means for removably fixing portions of the upper side panel of said harness to side portions of side lengths of said outstanding wall include elongate side extensions of the free ends of said upper side panel carrying removable engaging means thereon to engaging removable engaging means fixed on and along the outer sides of said upstanding wall side lengths.

19. A device as in claim 13 wherein said base pad is a lambskin with the wool side thereof upwards as the top surface thereof and the skin side thereof normally downwards as the bottom surface thereof, the inner and upper portions of said upstanding wall being made up of a lambskin having the wool side inwards toward the center of the base pad and the skin side outwards therefrom.

* * * * *